US008667971B2

(12) United States Patent
Makkar et al.

(10) Patent No.: US 8,667,971 B2
(45) Date of Patent: Mar. 11, 2014

(54) METHODS OF PREPARING CUSTOMIZED MOUTHPIECES FOR ENHANCING ATHLETIC PERFORMANCE

(75) Inventors: Anil Kumar Makkar, Truro (CA); Trevor Robert Laingchild, Burlington (CA); Preston Joseph Dokuchie, Burlington (CA); Joseph Youssif Andary, Oakville (CA); Kris Shailer Astaphan, Oakville (CA); Deryl Dangstorp, Regina (CA)

(73) Assignee: Nova Scotia Limited, Central Onslow (CA)

( * ) Notice: Subject to any disclaimer, the term of this patent is extended or adjusted under 35 U.S.C. 154(b) by 588 days.

(21) Appl. No.: 12/871,396

(22) Filed: Aug. 30, 2010
(Under 37 CFR 1.47)

(65) Prior Publication Data

US 2011/0209714 A1 Sep. 1, 2011

Related U.S. Application Data

(60) Provisional application No. 61/237,900, filed on Aug. 28, 2009.

(51) Int. Cl.

| | |
|---|---|
| ***A61F 13/00*** | (2006.01) |
| ***A61F 11/00*** | (2006.01) |
| ***A61C 5/14*** | (2006.01) |
| ***A61B 19/00*** | (2006.01) |
| ***A61C 3/00*** | (2006.01) |
| ***A61C 11/00*** | (2006.01) |
| ***A61C 9/00*** | (2006.01) |
| ***A61N 1/00*** | (2006.01) |

(52) U.S. Cl.
USPC ..... 128/861; 128/846; 128/857; 128/862; 128/898; 433/6; 433/7; 433/18; 433/19; 433/24; 433/213; 433/214; 607/2; 607/46; 607/47

(58) Field of Classification Search
USPC ..... 128/846, 848, 857, 859–861, 862, 898; 433/6, 7, 18, 19, 24, 213, 214; 607/2, 607/46–47
See application file for complete search history.

(56) References Cited

U.S. PATENT DOCUMENTS

| | | | |
|---|---|---|---|
| 2,702,032 | A | 2/1955 | Freedland |
| 2,833,278 | A | 5/1958 | Ross |

(Continued)

FOREIGN PATENT DOCUMENTS

| | | | |
|---|---|---|---|
| EP | 0590208 | A2 | 4/1994 |
| GB | 2259649 | A | 3/1993 |

(Continued)

OTHER PUBLICATIONS

International Search Report issued Jan. 12, 2011 in respect of corresponding International Application No. PCT/CA2010/001333.

(Continued)

*Primary Examiner* — Patricia Bianco
*Assistant Examiner* — Brandon L Jackson
(74) *Attorney, Agent, or Firm* — Bereskin & Parr LLP/S.E.N.C.R.L., s.r.l.

(57) ABSTRACT

A spacing member can be positioned between teeth of the athlete to obtain a desired position between the upper and lower jaw. At least one bite registration can be recorded while the lower jaw is in the desired position. The desired position can range from the physiological resting position, to a performance position, in which the lower jaw is positioned anteriorly in relation to the physiological resting position. The mouthpiece can be formed to include a pair of bite portions configured to substantially space apart and position the jaws generally according to the desired position, and a connecting portion can connect the bite portions within the mouth. The connecting portion may extend labially along the anterior teeth and associated gum region of the lower jaw, and may be sized and shaped to substantially lie out of the way so as to not impede speech of the athlete.

35 Claims, 12 Drawing Sheets

(56) References Cited

U.S. PATENT DOCUMENTS

| | | | | |
|---|---|---|---|---|
| 3,407,808 | A | 10/1968 | Baldwin | |
| 3,411,501 | A | 11/1968 | Greenberg | |
| 3,457,916 | A | 7/1969 | Wolicki | |
| 3,496,936 | A | 2/1970 | Gores | |
| 3,513,838 | A | 5/1970 | Foderick et al. | |
| 4,114,614 | A | 9/1978 | Kesling | |
| 4,337,765 | A | 7/1982 | Zimmerman | |
| 4,672,959 | A | 6/1987 | May et al. | |
| 4,765,324 | A | 8/1988 | Lake, Jr. | |
| 5,018,533 | A * | 5/1991 | Hawkins | 128/848 |
| 5,082,007 | A | 1/1992 | Adell | |
| 5,152,301 | A | 10/1992 | Kittelson et al. | |
| 5,339,832 | A | 8/1994 | Kittelson et al. | |
| 5,365,946 | A | 11/1994 | McMillan | |
| 5,385,155 | A | 1/1995 | Kittelsen et al. | |
| 5,386,821 | A | 2/1995 | Poterack | |
| 5,406,963 | A | 4/1995 | Adell | |
| 5,490,520 | A | 2/1996 | Schaefer et al. | |
| 5,566,684 | A | 10/1996 | Wagner | |
| 5,584,687 | A | 12/1996 | Sullivan et al. | |
| 5,718,575 | A | 2/1998 | Cross, III | |
| 5,826,581 | A * | 10/1998 | Yoshida | 128/859 |
| 5,865,619 | A | 2/1999 | Cross, III et al. | |
| 5,931,164 | A | 8/1999 | Kiely et al. | |
| 6,012,919 | A | 1/2000 | Cross, III et al. | |
| 6,082,363 | A | 7/2000 | Washburn | |
| 6,092,524 | A | 7/2000 | Barnes, Sr. | |
| 6,109,266 | A | 8/2000 | Turchetti | |
| 6,152,138 | A | 11/2000 | Brown et al. | |
| 6,178,967 | B1 | 1/2001 | Barnes, Sr. | |
| 6,200,133 | B1 | 3/2001 | Kittelsen | |
| 6,237,601 | B1 | 5/2001 | Kittelsen et al. | |
| 6,371,758 | B1 * | 4/2002 | Kittelsen | 433/6 |
| 6,415,794 | B1 | 7/2002 | Kittelsen et al. | |
| 6,491,036 | B2 | 12/2002 | Cook | |
| 6,505,625 | B1 | 1/2003 | Uenishi | |
| 6,505,626 | B2 | 1/2003 | Kittelsen et al. | |
| 6,505,627 | B2 | 1/2003 | Kittelsen et al. | |
| 6,505,628 | B2 | 1/2003 | Kittelsen et al. | |
| 6,508,251 | B2 | 1/2003 | Kittelsen et al. | |
| 6,510,853 | B1 | 1/2003 | Kittelsen et al. | |
| 6,539,943 | B1 | 4/2003 | Kittelsen et al. | |
| 6,553,996 | B2 | 4/2003 | Kittelsen et al. | |
| 6,581,604 | B2 | 6/2003 | Cook | |
| 6,588,430 | B2 | 7/2003 | Kittelsen et al. | |
| 6,598,605 | B1 | 7/2003 | Kittelsen et al. | |
| 6,626,180 | B1 | 9/2003 | Kittelsen et al. | |
| 6,675,806 | B2 | 1/2004 | Kittelsen et al. | |
| 6,675,807 | B2 | 1/2004 | Kittelsen et al. | |
| 6,691,710 | B2 | 2/2004 | Kittelsen et al. | |
| 6,820,623 | B2 | 11/2004 | Cook | |
| 7,299,804 | B2 | 11/2007 | Kittelsen et al. | |
| 7,404,403 | B2 | 7/2008 | Farrell | |
| 7,451,767 | B2 | 11/2008 | Keropian | |
| 2002/0066454 | A1 | 6/2002 | Kittelsen et al. | |
| 2002/0144686 | A1 | 10/2002 | Cook | |
| 2002/0144690 | A1 | 10/2002 | Kittelsen et al. | |
| 2003/0101999 | A1 | 6/2003 | Kittelsen et al. | |
| 2004/0103905 | A1 | 6/2004 | Farrell | |
| 2006/0011204 | A1 | 1/2006 | Maher | |
| 2008/0138766 | A1 | 6/2008 | Jansheski | |
| 2008/0206707 | A1 | 8/2008 | Gelb | |
| 2008/0215113 | A1 * | 9/2008 | Pawlowicz | 607/46 |
| 2009/0020130 | A1 | 1/2009 | Eubank | |

FOREIGN PATENT DOCUMENTS

| | | | |
|---|---|---|---|
| WO | 9806349 | A1 | 2/1998 |
| WO | 2006116177 | A2 | 11/2006 |

OTHER PUBLICATIONS

International Search Report issued Dec. 8, 2010 in respect of related International Application No. PCT/CA2010/001226.

P. Bracco, A. Deregibus, R. Piscetta, Effects of different jaw relations on postural stability in human subjects, Neuroscience Letters, 2004, pp. 228-230, vol. 356.

Shawn M. Arent, Jennifer McKenna, & Devon Golem, Effects of a neuromuscular dentistry-designed mouthguard on muscular endurance and anaerobic power, Comparative Exercise Physiology, 2010.

Arent, S.M., Pellegrino, J., McKenna, J., & Jaouhari, C.A., Effects of a neuromuscular dentistry-designed mouthguard on muscular endurance and anaerobic power, Dept. Of Exercise Science & Sport Studies, Rutgers, The State University of New Jersey, New Brunswick, NJ.

Shawn M. Arent, Jennifer McKenna, & Devon Golem, Effects of a neuromuscular-dentistry designed mouthguard on muscular endurance and anaerobic power, Rutgers University Human Performance Laboratory, Department of Exercise Science & Sport Studies, Rutgers, the State University of New Jersey, New Brunswick, NJ.

PPM Australia Launch—YouTube, "PPM Australia Launch—Pure Power Edge", http://www.youtube.com/watch?v=IY171h8MHAI&feature=related, uploaded by PPMAustralasia, Feb. 24, 2008, 9minutes 56 seconds, 2 pages.

"Motor Reflex testing for TMJ", http://video.google.com/videoplay?docid=6480768754447347974, unknown author, 2008, 8 minutes 33 seconds, 1 page.

Dr. Shirley Cheong explained the power of the PPM with the Pen Test.—YouTube, "Dr. Shirley Cheong explained the power of the PPM with the Pent Test.", http://www.youtube.com/watch?v=Pd_hF3-U4vE&feature=related, uploaded by smilingstardental, May 12, 2009, 4 minutes 41 seconds, 2 pages.

Dr. Volinder Dhesi Live on City TV (Calgary)—YouTube, "Dr. Volinder Dhesi Live on City TV (Calgary)", http://www.youtube.com/watch?v=dUvIO-U3aN0, uploaded by ppmmouthguard, Aug. 19, 2009, 6 minutes 30 seconds, 2 pages.

"WSW PPM LVI Visions 2009", W. Cott Wagner, DMD, LVIF, Cosmetic, Neuromuscular, and Sports Dentistry, www.jaxsmile.com, Jun. 6, 2009, 3 pages.

"Pen Test Question-Joe Dindo", Anil Makkar, Aug. 25, 2009, 11 pages.

* cited by examiner

METHODS OF PREPARING CUSTOMIZED MOUTHPIECES FOR ENHANCING ATHLETIC PERFORMANCE

CROSS-REFERENCE TO RELATED APPLICATION

This application claims priority to U.S. Provisional Application No. 61/237,900 filed on Aug. 28, 2009, the entire contents of which are hereby incorporated herein by reference.

FIELD

This specification relates to customized mouthpieces for enhancing athletic performance.

BACKGROUND

The following paragraphs are not an admission that anything discussed in them is prior art or part of the knowledge of persons skilled in the art.

U.S. Pat. No. 6,178,967 to Barnes, Sr. discloses a mouth protector designed to minimize discomfort and speech interference associated with conventional athletic mouthpieces and includes a pair of posterior splints for encompassing the posterior teeth. Each posterior splint includes an inner and outer wall, both of which terminate at or near the gum line so as to minimize discomfort to the wearer. The posterior splints may be interlinked with a connecting strip that is disposed behind the anterior teeth and extends across the wearer's palate. The device is designed to protect either the upper or lower posterior teeth while allowing a wearer's tongue to contact the anterior teeth thereby minimally interfering with clear speech.

United States Patent Publication No. 20080206707 to Gelb discloses oral appliances which reside within the mouth and which bring the lower jaw and/or the tongue forward to increase airway flow during sleep or physical activity. The oral appliances are constructed such that they may be optionally customized to an individual user's mouth shape. Methods of using such oral appliances are also provided.

United States Patent Publication No. 20090020130 to Eubank discloses an oral appliance that includes a first arch adapted to receive at least some of a user's teeth and a second arch adapted to receive at least some of the user's teeth. The first arch includes an anterior substantially planar region. The second arch includes an anterior bearing point that contacts the anterior substantially planar region of the first arch when the user bites down with the oral appliance inserted in the user's mouth and the user's temporomandibular joint in its proper natural position. The oral appliance may be used to help maintain stability of one or more aspects of the user's masticatory system, including at least helping to maintain proper positioning of the user's temporomandibular joint.

INTRODUCTION

In an aspect of this specification, a method of preparing a customized mouthpiece for an athlete, the athlete having a mouth, an upper jaw with anterior and posterior teeth, a lower jaw with anterior and posterior teeth, and a temporomandibular joint movably connecting the upper and lower jaws, comprises the steps of: (a) positioning a spacing member between the teeth of the upper and lower jaws to obtain a desired position between the upper and lower jaw; (b) recording at least one bite registration of the athlete while the lower jaw is in the desired position; and (c) forming the mouthpiece, the mouthpiece including a pair of bite portions configured to substantially space apart and position the lower jaw relative to the upper jaw generally according to the desired position, and a connecting portion connecting the bite portions within the mouth, each of the bite portions including an upper engagement surface facing the posterior teeth of the upper jaw and a lower engagement surface facing the posterior teeth of the lower jaw, the upper and lower engagement surfaces configured to engage the upper and lower posterior teeth, respectively, and substantially prevent movement of the lower jaw relative to the upper jaw.

In an aspect of this specification, a method of preparing a customized mouthpiece for an athlete, the athlete having a mouth, an upper jaw with anterior and posterior teeth, a lower jaw with anterior and posterior teeth, and a temporomandibular joint movably connecting the upper and lower jaws, comprises the steps of: recording a bite registration of the athlete when the lower jaw is substantially in a centric occlusion position; taking impressions of the anterior and posterior teeth of the upper and lower jaws; generating upper and lower molds from the impressions; mounting the upper and lower molds using an articulator; inserting the bite registration in the upper and lower molds to space apart the upper and lower molds; shifting the upper and lower molds in the articulator to increase a vertical amplitude by a first predetermined dimension and increase an anterior-posterior amplitude by a second predetermined dimension, thereby defining a desired position; and forming the mouthpiece between the upper and lower molds while substantially in the desired position, the mouthpiece including a pair of bite portions configured to substantially space apart and position the lower jaw relative to the upper jaw according to the desired position, and a connecting portion connecting the bite portions within the mouth, each of the bite portions including an upper engagement surface facing the posterior teeth of the upper jaw and a lower engagement surface facing the posterior teeth of the lower jaw, the upper and lower engagement surfaces configured to engage the upper and lower posterior teeth, respectively, and substantially prevent movement of the lower jaw relative to the upper jaw.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
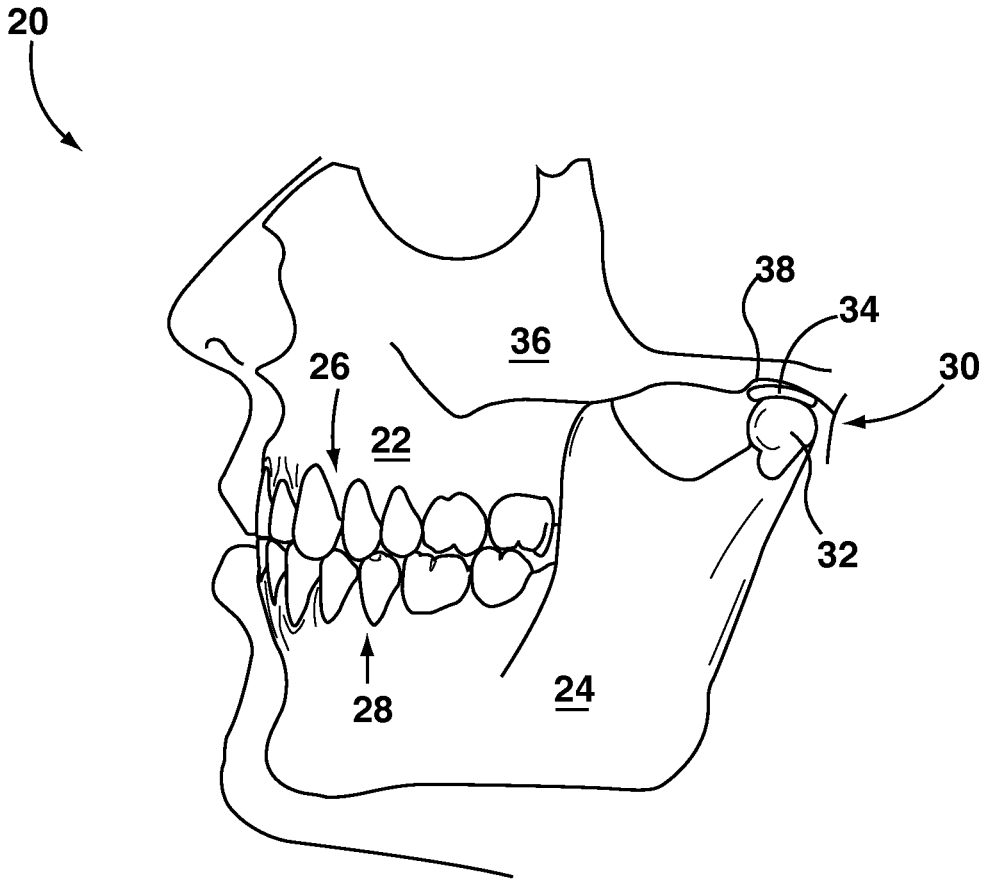
FIG. 1 is a partial profile view of the head of an athlete showing the general location of the teeth, jaws and temporomandibular joint.

Referring to FIG. 1, a portion 20 of an athlete's head is shown with sections broken away and with muscles, nerves and other tissue omitted to illustrate the upper jaw or maxilla 22 and the lower jaw or mandible 24. The upper jaw 22 includes teeth 26; the lower jaw 24 includes teeth 28. The temporomandibular joint (TMJ) 30 movably connects the upper and lower jaws 22, 24 and generally consists of the condyle 32 of the lower jaw 24, the articular disk 34, and the glenoid fossa 38 of the temporal bone 36.

It has been said that the TMJ 30 is the most complicated joint in the human body. The TMJ 30 is the articulation between the condyle 32 of the mandible 24 and the squamous portion of the temporal bone 36. The condyles 32 are elliptically shaped with its long axis orientated mediolaterally. The articular surface of the temporal bone 36 is composed of the concave glenoid fossa 38 and the convex articular eminence. The meniscus is a fibrous saddle shaped structure that separates the condyle 32 and the temporal bone 36. The meniscus and its attachments divide the joint into superior and inferior spaces. When the mouth opens, two distinct motions occur at the joint. The first is rotational around a horizontal axis through the condylar heads. The second is translational; the condyle 32 and meniscus move together anteriorly beneath the eminence. Several muscles control the movement of not only the muscles of the face and jaw but of the TMJ 30 themselves. The proper function and balance of the TMJ 30 is related to the position of the teeth 26, 28 and the movement of muscles controlled by the central nervous system.

The term "neuromuscular" refers to the science of dentistry. Neuromuscular dentistry is a medical field that seeks to understand the relationships of the TMJs, muscles, teeth and nerves, and focuses on correcting misalignment of the jaw at the TMJ. Neuromuscular dentistry uses instrumentation to measure the patient's jaw movements via computerized mandibular scanning (CMS) or jaw motion analysis (JMA), muscle activity via EMG and TMJ sounds via electro-sonography (ESG) or joint vibration analysis (JVA) to assist in identifying joint derangements. There are various condylar positions within the glenoid fossa, including: the centric occlusion position, the habitual rest position, the physiological resting position, and maximum opening. The centric occlusion position can be defined as the position in which the teeth are in maximum intercuspation. The physiological resting position can be defined as the position of the mandible when at rest, with the condyles in a neutral, unstrained position in the glenoid fossa. Combining both CMS or JMA with low frequency transcutaneous electric neural stimulation (TENS), the neuromuscular dentist is able to locate the physiological resting position and record the relationship between the upper and lower jaw. EMG can be used to measure pre-, mid- and post-treatment conditions before and after TENS.

It has been shown that by using a mouthpiece to maintain the physiological resting position, an athlete can enhance their athletic performance. (See, for example: "Effects of different jaw relations on postural stability in human subjects", P. Bracco, A. Deregibus and R. Piscetta, *Neuroscience Letters*, Volume 356, Issue 3, 19 Feb. 2004, Pages 228-230; and "Effects of a neuromuscular dentistry designed mouthguard on muscular endurance and anaerobic power", S. M. Arent, J. McKenna and D. L. Golem, *Comparative Exercise Physiology,* 2010. The entirety of each is hereby incorporated by reference.) In particular, balance, flexibility, range of motion, strength, vertical leap, endurance and/or other physical performance characteristics of an athlete may be enhanced when the lower jaw is in the physiological resting position or near thereto.

The teachings herein relate to methods of preparing a customized mouthpiece for the mouth of an athlete. The teachings herein can enable the preparation of a mouthpiece that exhibits a neuromuscular effect, but without the requirement of neuromuscular dentistry instrumentation. The mouthpiece can be formed as an approximation to the physiological resting position of the athlete, or as an approximation to a performance enhancing position that is close to the physiological resting position. Because neuromuscular instrumentation is not required, the mouthpieces can be produced in less time and at less cost.

Figure 2:
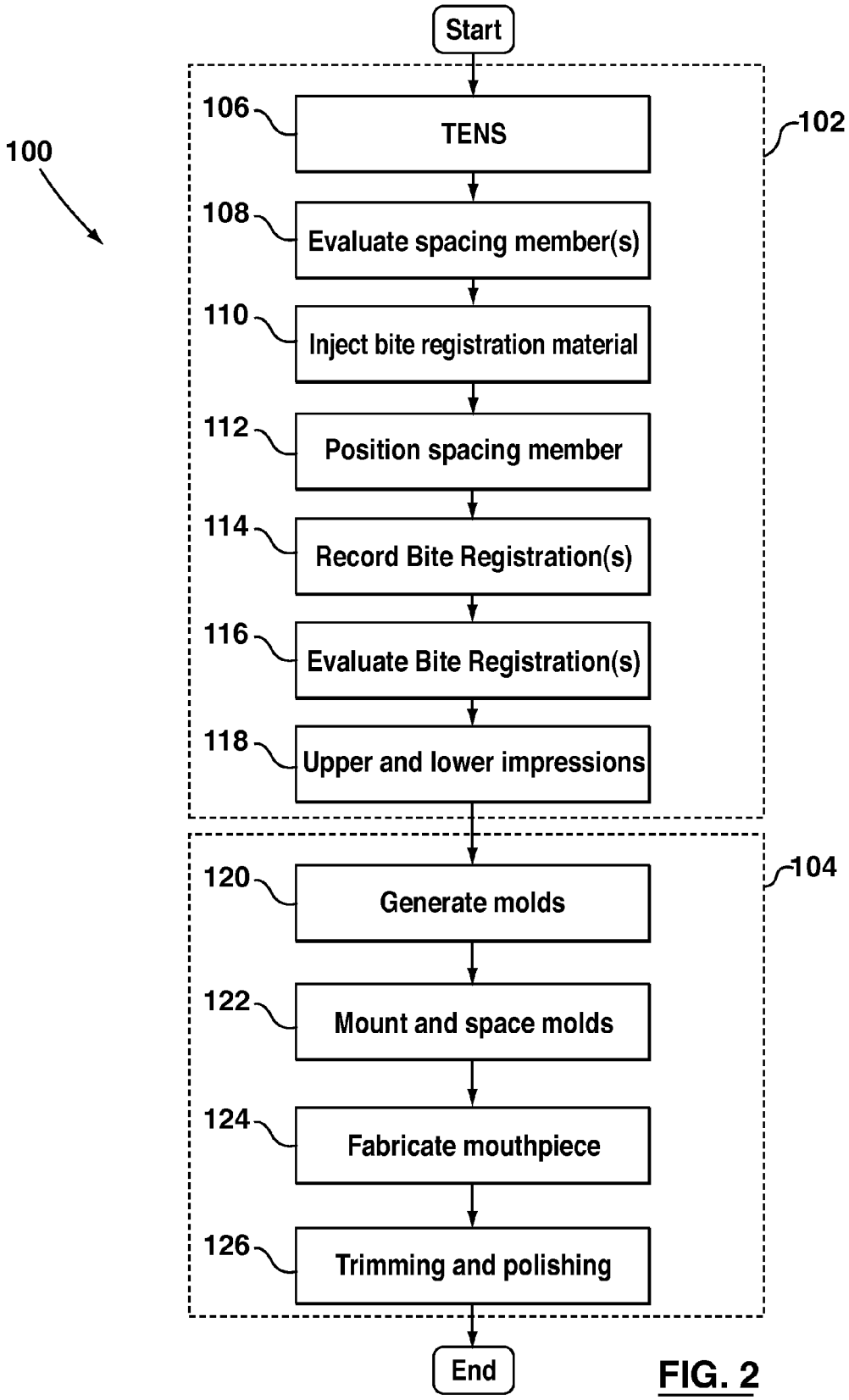
FIG. 2 is a flow chart showing various steps of an example method of preparing a customized mouthpiece.

Referring to FIG. 2, an example method 100 includes various steps of preparing a customized mouthpiece. The method 100 can include a primary stage 102 and a secondary stage 104. The primary stage 102 relates to the analysis of the athlete, whereas the secondary stage 104 relates to the preparation of the mouthpiece. In the primary stage 102, at least one bite registration of the athlete can be recorded, typically in an office or clinic setting. The secondary stage 104 is usually carried out in a laboratory or manufacturing setting, and can be at a separate location from the primary stage 102.

In step 106, which is optional, the athlete is hooked up to an apparatus for TENS. For example, a J4 MYOMONITOR™ or J5 MYOMONITOR™ system (Myotronics, Inc.) can be used. MYO-TRODE SG™ (Myotronics, Inc.) electrodes can be applied to the skin after preparation using 99% isopropyl alcohol. TENS electrodes can be placed above cranial nerves V, VII and XI. (The J4 MYOMONITOR™ does not provide for stimulation of cranial nerves XI.)

TENS can be applied anteriorly to the left and right TMJs at the coronoid notch. Low electrical impulse frequency can used to stimulate two nerves specifically, namely, cranial nerve V and cranial nerve VII. Cranial nerve V is otherwise referred to as the trigeminal nerve, and generally controls the mandible and balance. Cranial nerve VII is otherwise referred to as the facial nerve, and generally controls the facial muscle expressions of the face. TENS can be applied for between 45 to 75 minutes to enable thorough deprogramming of the muscles in the face, such as the masseters, anterior temporalis, posterior temporalis, and the digastrics. Deprogramming allows the neuromuscular dentist to determine the physiological resting position.

To promote good results during TENS: the lights can be turned off and sound can be kept to a minimum to avoid distracting the athlete; good posture can be encouraged; and the athlete can be instructed to relax the lower jaw, and allow the lower jaw to hang naturally so that the teeth and lips are not touching. For safety reasons, TENS generally should not to be used on athletes who are pregnant, have a pacemaker, active cancer, temporal arteritis, and/or dermatological skin disorder.

The inventors have discovered that a TENS cycling routine can be used to thoroughly deprogram and break the "engrams" of the facial muscles to allow the physiological resting position (and performance position, as described herein) to be determined. The routine can be carried out as follows. TENS can be applied to the athlete, as described above, but at an increasing amplitude level, while monitoring the athlete using EMG as described above. As the amplitude is steadily increased, the lower jaw is extended outwardly (anteriorly), until the lower teeth contact the upper teeth. Interference in the EMG signals will indicate the point at which the teeth touch. The TENS apparatus may then be set at an amplitude that is slightly less than the "maximum" amplitude that caused the teeth to touch (e.g., 16 milliamps using the J5 MYOMONITOR™ system). For example, the TENS apparatus can be set to 2 milliamps less than the maximum amplitude. The athlete can then be treated for about 10 to 20 seconds. The TENS apparatus may then be shut off to cease stimulation, and the athlete can then be directed to release the lower jaw and allow it to relax to a natural resting position. This cycle may be repeated at least two or more additional times.

Further details may be provided with reference to copending U.S. patent application Ser. No. 12/852,879, the entirety of which is hereby incorporated by reference.

Figure 3A:
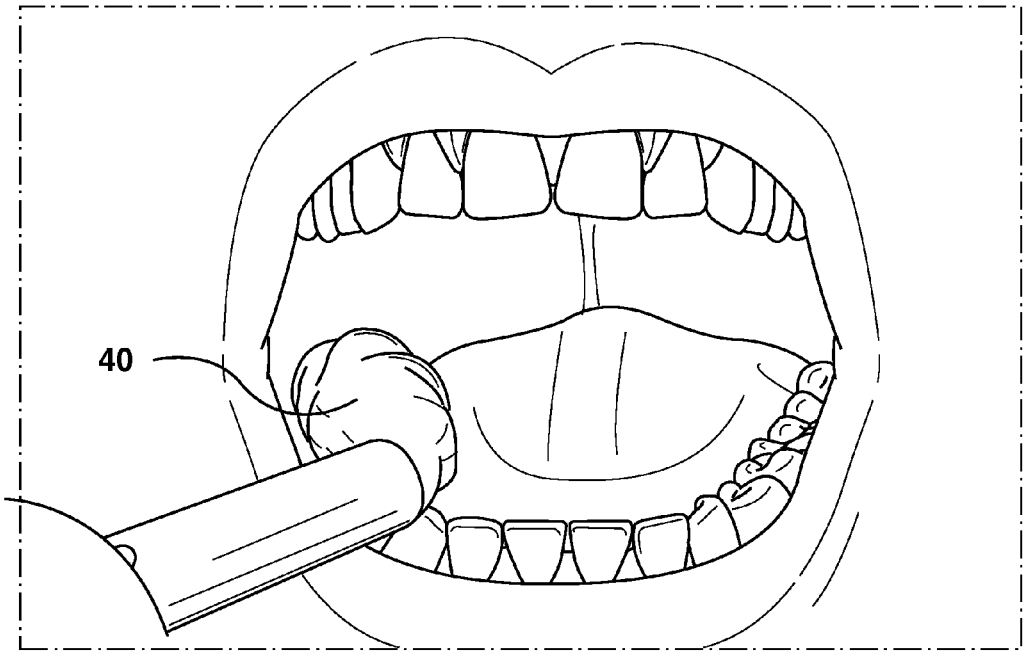
FIGS. 3A and 3B are front views of an athlete showing injection of bite registration material.
Figure 3B:
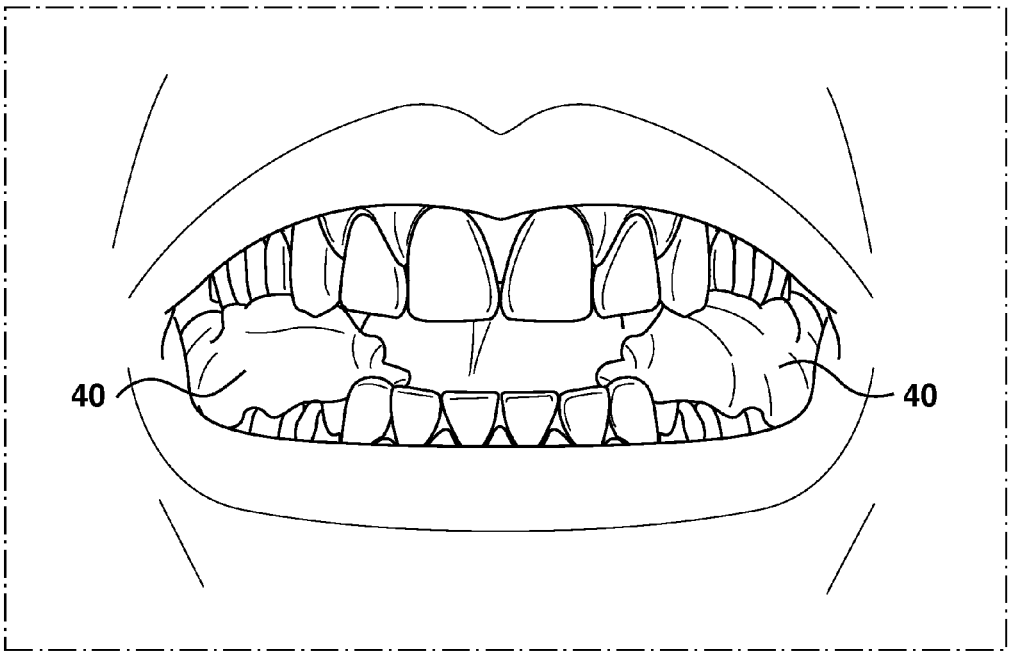

In step 110, and with reference to FIGS. 3A and 3B, bite registration material 40 can be injected into the athlete's mouth, particularly onto the lower posterior teeth (for example, from the first bicuspid to the last molar), on both the left and right sides. Care should be taken to ensure that a sufficient amount of bite registration material is injected to capture the record, but not too much. A quick set material can be used for recording the bite registration; good results have been obtained using AQUASIL ULTRA MONOPHASE FAST SET™ materials.

Figure 4A:
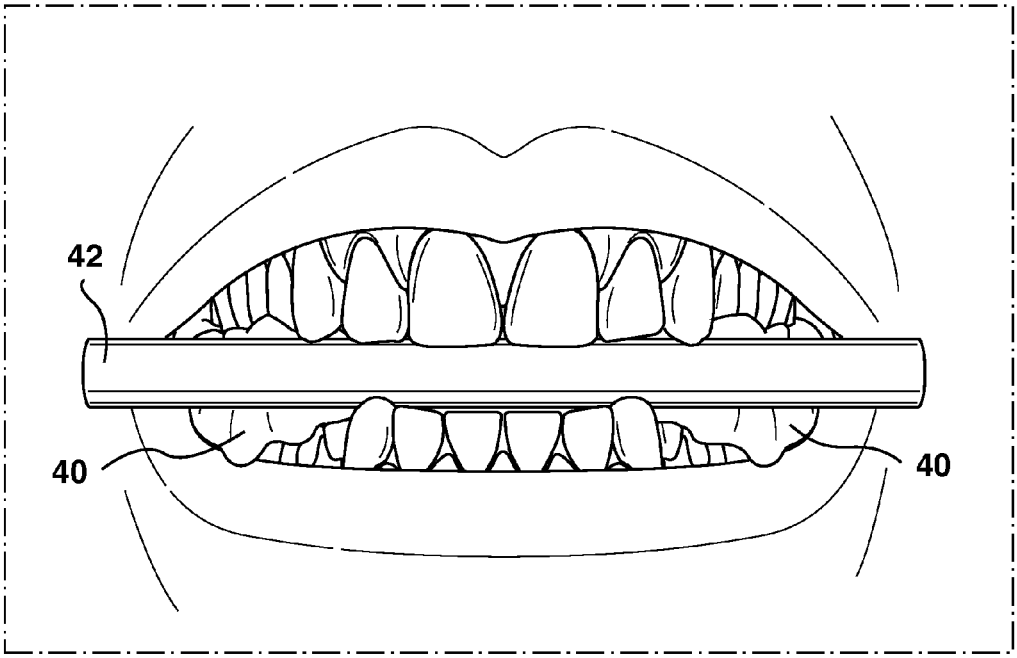
FIGS. 4A and 4B are front views of an athlete showing positioning of a spacing member.
Figure 4B:
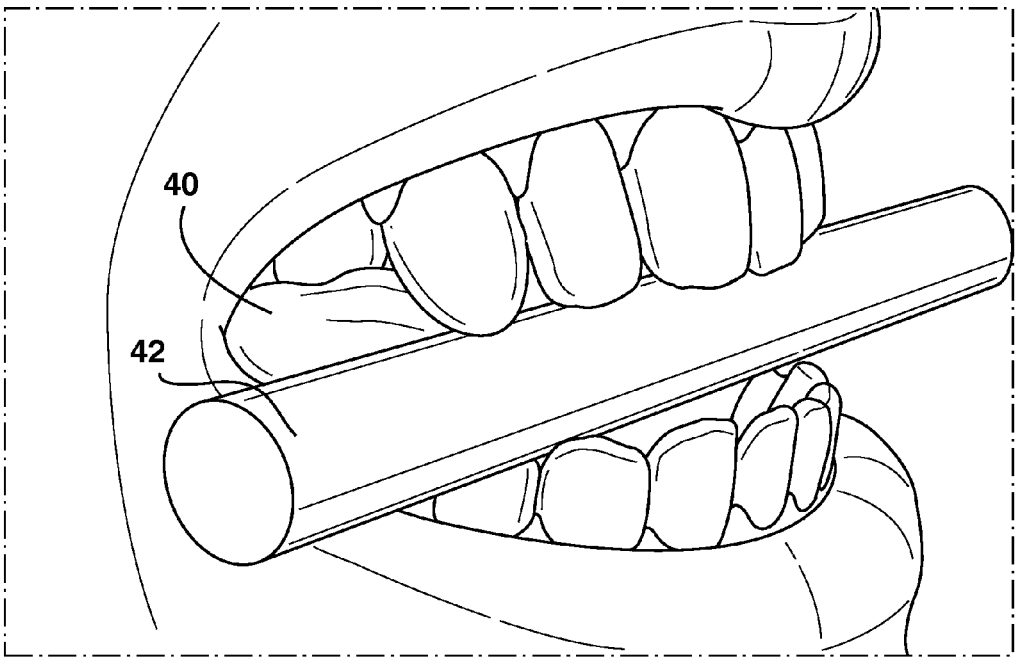

In step 112, and with reference to FIGS. 4A and 4B, a spacing member 42 can be positioned between the athlete's teeth. The spacing member 42 can be positioned between the athlete's teeth while the athlete sitting or standing, and preferably with idealized posture. In some examples, and as illustrated, the spacing member 42 can take the form of a cylindrical shaft having a diameter of between about 1 to 12 mm, or between about 2 to 7 mm. In some particular examples, the spacing member 42 can be a pen.

Figure 5:
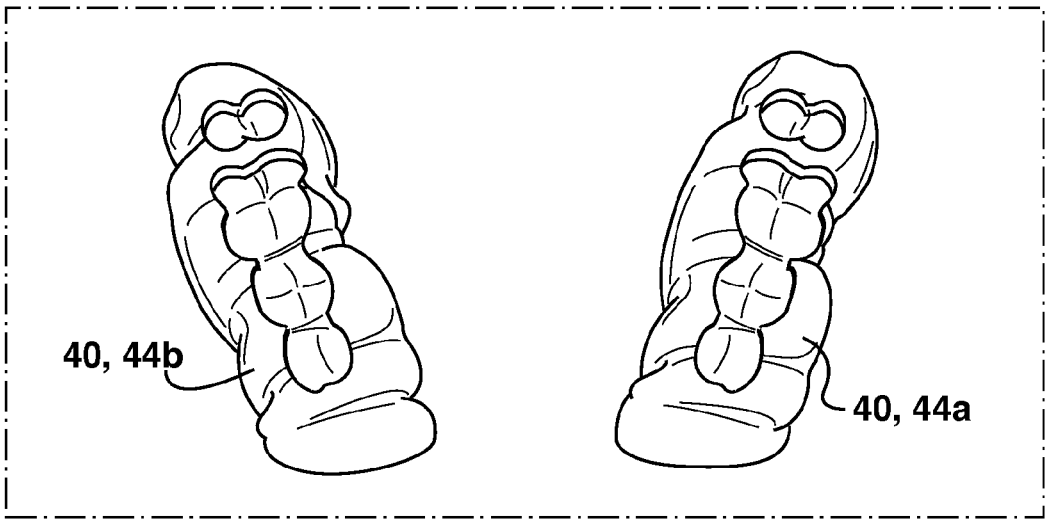
FIG. 5 is a perspective view of a bite registration record.

In step 114, with the spacing member 42 can be positioned on the distal of the lower right and left canine, the athlete can close his/her jaw so that the spacing member 42 is engaged between the upper and lower teeth and thus compress the bite registration material 40 between the posterior teeth of the upper and lower jaws. The athlete can then hold this position until the bite registration material 40 sets or hardens. Referring to FIG. 5, a bite registration record having a left hand side 44*a* and a right hand side 44*b* is thereby formed.

Care should be taken, in step 110, to ensure that the bite registration material 40 is not injected too far anteriorly to interfere with the spacing member 42. For example, the bite registration material 40 should not cover the cuspid or the front half of the bicuspid.

As illustrated, the spacing member 42 can be positioned generally between the anterior and posterior teeth of the athlete, for both the upper and lower teeth. Using FDI World Dental Federation notation, posterior teeth can be generally defined as teeth which are numbers 1-8, 1-7, 1-6, 1-5, 1-4, 2-4, 2-5, 2-6, 2-7, 2-8, and anterior teeth can be generally defined as teeth which are numbers 1-3, 1-2, 1-1, 2-1, 2-2, 2-3. The position of the spacing member 42 may vary, for example, depending on the degree of overbite. In some particular examples, the spacing member 42 can be generally retained in space between teeth numbers 1-4 and 1-3, 2-3 and 2-4, 4-4 and 4-3, 3-3 and 3-4 (see FIGS. 4A and 4B). In some particular examples, the spacing member 42 can be generally retained in space between teeth numbers 1-3 and 1-2, 2-2 and 2-3, 4-4 and 4-3, 3-3 and 3-4. Other configurations may be possible and are within the scope of the teachings herein.

Referring back to step 108 in FIG. 2, which is optional, one or more of the spacing members 42 can be provided, each having varying diameters, and can be evaluated for effect on the athlete's performance, prior to steps 110, 112 and 114. In some particular examples, three cylindrical spacing members 42 can be provided, one with a diameter of 1.5 mm, one with a diameter of 2.7 mm, and one with a diameter of 4.5 mm. To evaluate performance, each of the spacing members can be positioned, in turn, between the teeth of the upper and lower jaws, and can be evaluated by either quantitative or qualitative comparison based on one or more athletic performance characteristics. For example, balance, range of motion, flexibility, and/or strength tests can be carried out to determine which of the spacing members yields the greatest degree of performance enhancement. The particular spacing member with the best performance can then be selected for before continuing to steps 110, 112, 114. Even if only one spacing member 42 is provided, step 108 can be carried out evaluate the athlete's performance with and without the spacing member 42 in position.

Figure 6A:
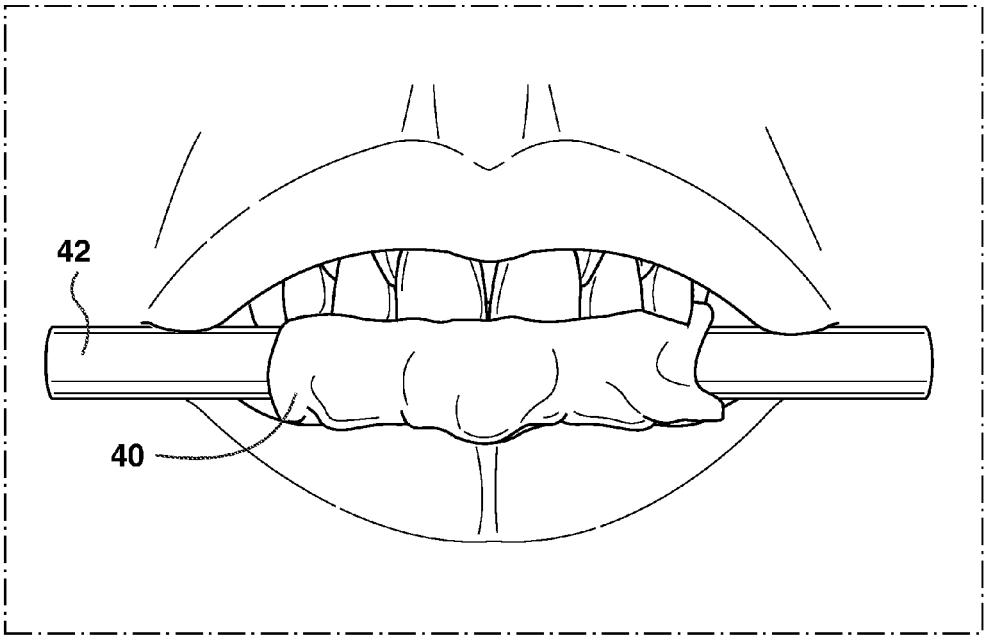
FIGS. 6A and 6B are a front view of an athlete with a spacing member and additional bite registration material and a perspective view of another bite registration record, respectively.
Figure 6B:
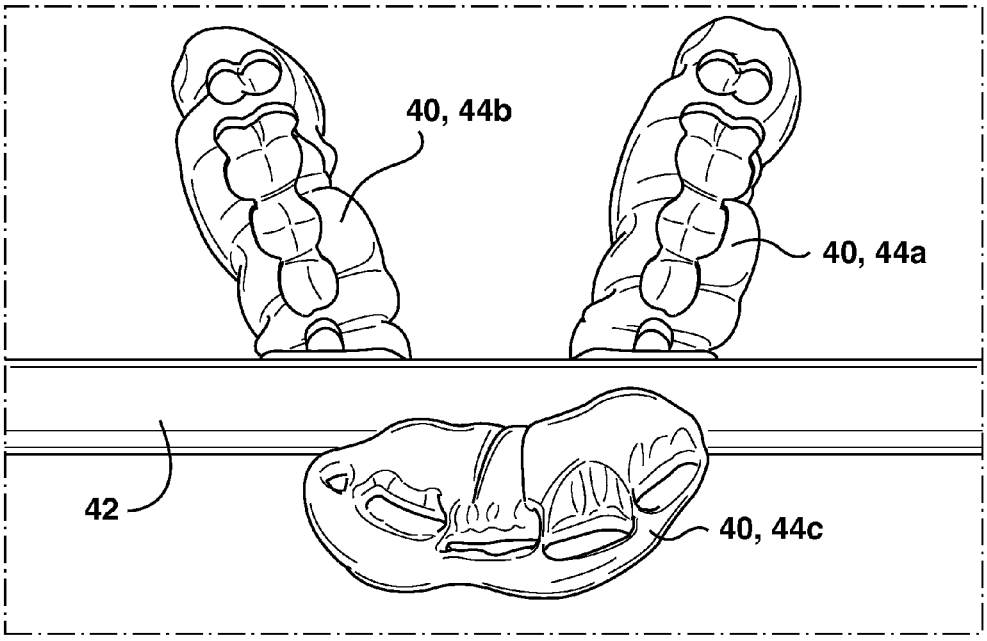

Referring to FIGS. 6A and 6B, as an optional step between steps 112 and 114, additional bite registration material 40 can be applied to the anterior teeth, thereby forming an anterior portion 44*c* of the bite registration record, which may provide more accurate positioning of the molds in step 122, described in further detail below. The spacing member 42 can be separated from the portions 44*a*, 44*b*, 44*c* prior to forming the mouthpiece.

In step 114, more than one bite registration can be recorded. For example, two, three, or more different bite registrations can be recorded, each with a spacing member 42 of varying diameter. Or, for example, a plurality of different bite registrations can be recorded, each with a different positioning of the spacing member 42 relative to the teeth.

In step 116, the at least one bite registration record can be evaluated. Generally, the bite registrations can be evaluated by either quantitative or qualitative comparison based on one or more athletic performance characteristics. For example, balance, range of motion, flexibility, and/or strength tests can be carried out to determine which of the bite registrations yields the greatest degree of performance enhancement. The particular bite registration with the best performance can then be selected and generally define the desired position of the lower jaw relative to the upper jaw, before continuing to forming of the mouthpiece in the secondary stage 104.

In step 118, impressions of the upper and lower jaws can be formed. Sufficient impression material should be used so that the entire anatomy including the incisive papilla and hamular notches are included, which will subsequently serve as reference landmarks. Again, good results have been obtained using AQUASIL ULTRA MONOPHASE FAST SET™ materials for the impressions. Also, suitable mold trays may be necessary. Good results have been obtained using the BORDER-LOCK™ tray system. Tray size should be checked for fit with the athlete prior to taking an impression. It should be appreciated that with respect to step 118, the sequence in which this step is carried out relative to the other steps in the primary stage 102 is not important. Step 118 could be carried out before step 108, or after 116, or otherwise.

The inventors have found that by use of a spacing member 42, a close approximation of the athlete's physiological resting position can be obtained. Furthermore, the inventors have found that, for the purposes of an athletic mouthpiece, optimal athletic performance is not necessarily obtained by positioning the jaws according to the physiological resting position. For the purposes of recording the bite registration, the desired position of the lower jaw relative to the upper jaw can range from the physiological resting position, to a performance position, in which the lower jaw is positioned anteriorly in relation to the physiological resting position. In some cases, the performance position is located 1.0 to 1.5 mm anteriorly relative to the physiological resting position. In some cases, the performance position is located 0.5 to 1.0 mm anteriorly relative to the physiological resting position. In some cases, the performance position is located 0.0 to 0.5 mm anteriorly relative to the physiological resting position. Using the spacing member, it can be possible to achieve a position that is a reasonably close approximation of either the physiological resting position or the performance position, which can be done without the time and expense associated with neuromuscular dentistry instrumentation (other than optional step 106).

Figure 7:
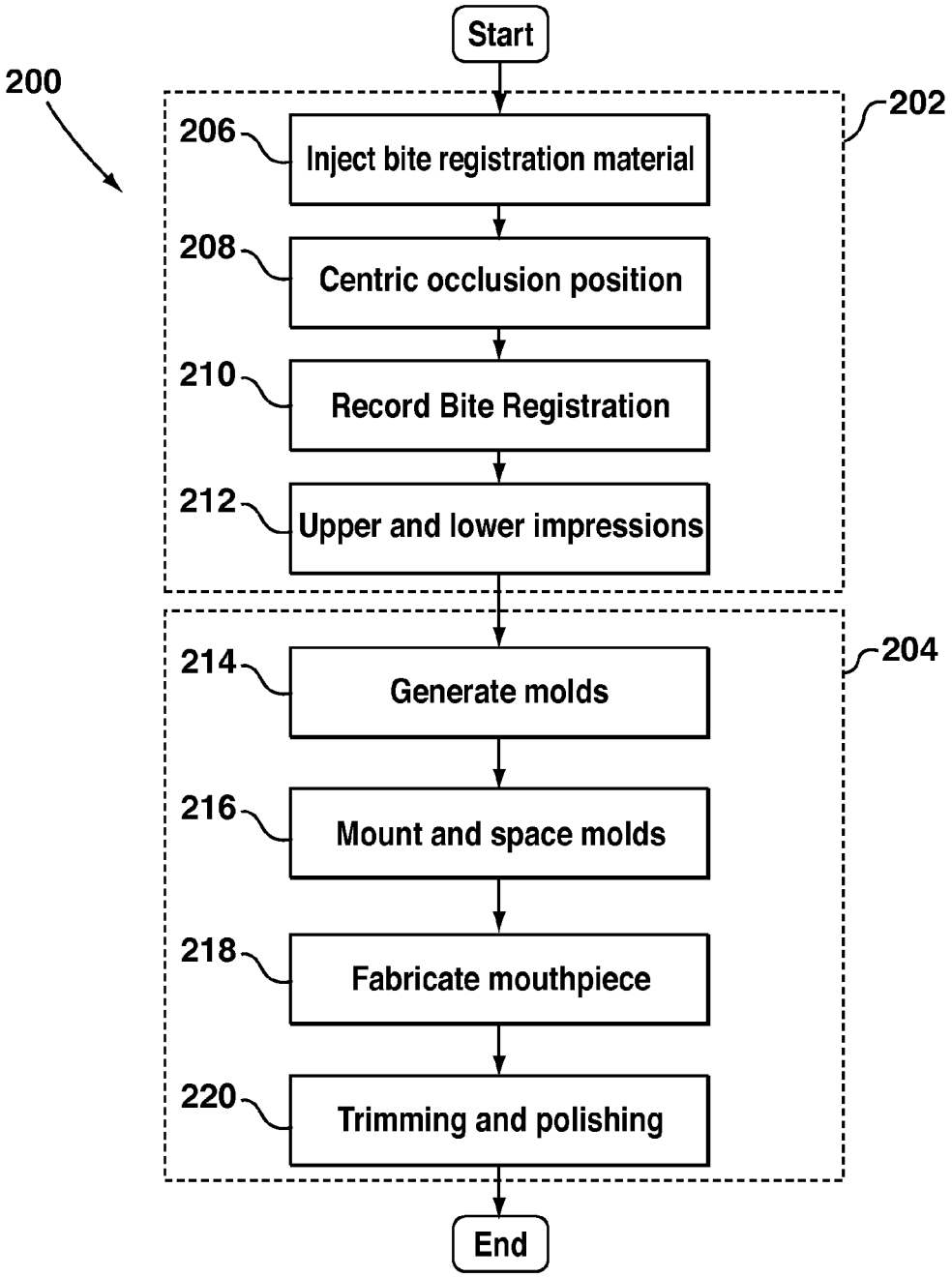
FIG. 7 is a flow chart showing various steps of an example method of preparing a customized mouthpiece.

Referring to FIG. 7, another example method 200 includes various steps of preparing a customized mouthpiece. The method 200 can include a primary stage 202 and a secondary stage 204. The primary stage 202 relates to the analysis of the athlete, whereas the secondary stage 204 relates to the preparation of the mouthpiece. In the primary stage 202, at least one bite registration of the athlete can be recorded, typically in an office or clinic setting. The secondary stage 204 is usually carried out in a laboratory or manufacturing setting, and can be at a separate location from the primary stage 202.

In step 206, bite registration material can be injected into the athlete's mouth, particularly onto the lower teeth, on both the left and right sides. Unlike step 110, the bite registration material need not only be applied to the posterior teeth, and be injected onto the anterior teeth as well. Care should be taken to ensure that a suitable amount of bite registration material is injected to capture the record. A quick set material can be used for recording the bite registration; good results have been obtained using AQUASIL ULTRA MONOPHASE FAST SET™ materials.

In step 208, the athlete can be directed to move the lower jaw to the centric occlusion position. In step 210, the athlete can then hold the centric occlusion position until the bite registration material sets or hardens. A bite registration record is thereby produced.

The inventors have found that, as a general rule, significant enhancement in athletic performance can be obtained if the anterior-posterior amplitude is between about 0.5 mm and 1.5 mm relative to the centric occlusion position. Furthermore, to ensure sufficient structural integrity of the mouthpiece, the vertical amplitude should be between about 1.8 mm to 3.8 mm. Using an articulator, as described below, the bite registration record of the centric occlusion position can then be used, in the secondary stage 204, and manually shifted to define a desired position of the lower jaw relative to the upper jaw to generate a customized mouthpiece for enhancing athletic performance.

In step 212, which is roughly the same as step 118, impressions of the upper and lower jaws can be formed. Sufficient impression material should be used so that the entire anatomy including the incisive papilla and hamular notches are included, which will subsequently serve as reference landmarks. Again, good results have been obtained using AQUASIL ULTRA MONOPHASE FAST SET™ materials for the impressions. Also, suitable mold trays may be necessary. Good results have been obtained using the BORDER-LOCK™ tray system. Tray size should be checked for fit with the athlete prior to taking an impression. It should be appreciated that with respect to step 212, the sequence in which this step is carried out relative to the other steps in the primary stage 202 is not important. Step 212 could be carried out before step 206, or otherwise.

Figure 8:
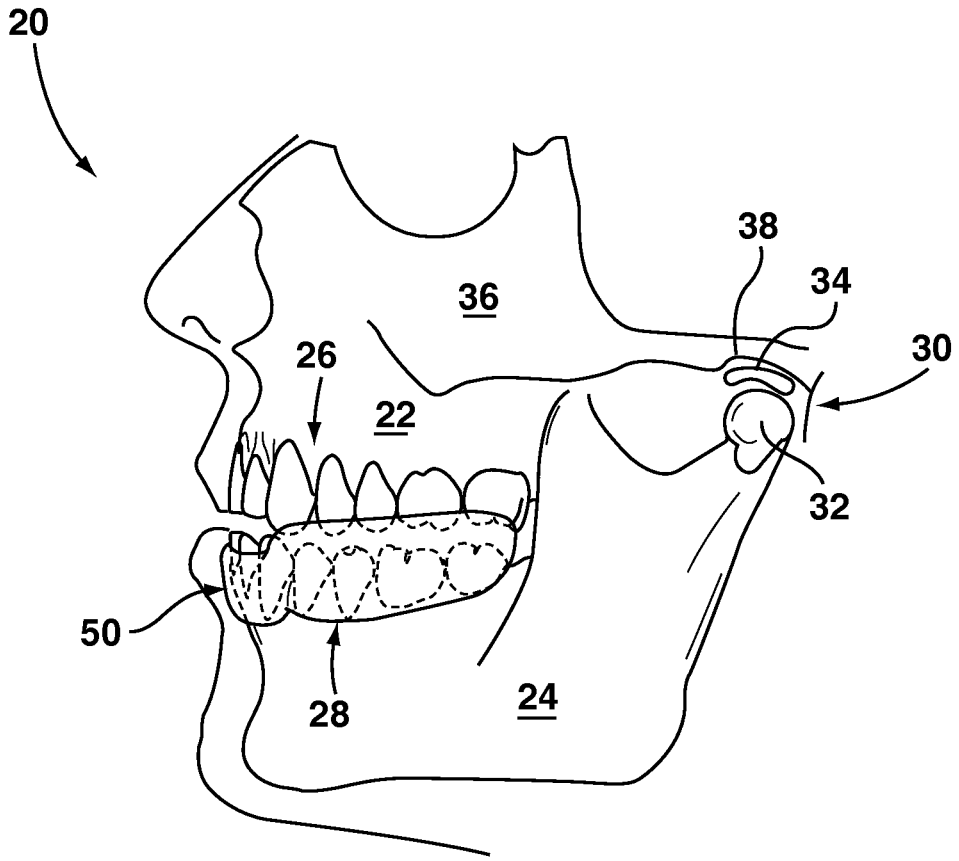
FIG. 8 is a partial profile view of the athlete shown in FIG. 1 wearing a customized mouthpiece.

FIG. 8 shows the portion 20 of an athlete's head with an example of a customized mouthpiece 50. The mouthpiece 50 is configured to substantially space apart and position the upper and lower jaws 22, 24 according to the desired position established in either of the steps 116 or 210, and substantially prevent movement of the lower jaw 24 relative to the upper jaw 22.

Unlike other mouthguard designs, the mouthpiece 50 is configured to maintain the lower jaw 24 in a desired position relative to the upper jaw 22 while not substantially impeding speech of the athlete. However, it should be appreciated that the mouthpiece 50 does not provide protection for upper teeth 26, and is considered a non-functioning orthotic, i.e. the athlete cannot eat while wearing the mouthpiece 50. The mouthpiece 50 can be suitable for athletes who are participating in sports in which the risk of impact is relatively low, and verbal communication may be important. For example, the mouthpiece 50 can be suitable for golfers, runners, cyclists, swimmers, tennis players, baseball players, volleyball players, archers, etc.

The mouthpiece 50 is further understood with reference to FIGS. 9A, 9B, 10A, 10B and 10C. The mouthpiece 50 includes a pair of bite portions 52*a*, 52*b*. The bite portions 52*a*, 52*b* are configured to substantially space apart and position the upper and lower jaws 22, 24 (see FIG. 8) according to the desired position. From the athlete's perspective, the bite portion 52*a* is configured for the right hand side of the mouth and the bite portion 52*b* is configured for the left hand side of the mouth. The mouthpiece 50 further includes a connecting portion 54 that connects the bite portions 52*a*, 52*b* within the mouth.

Figure 9A:
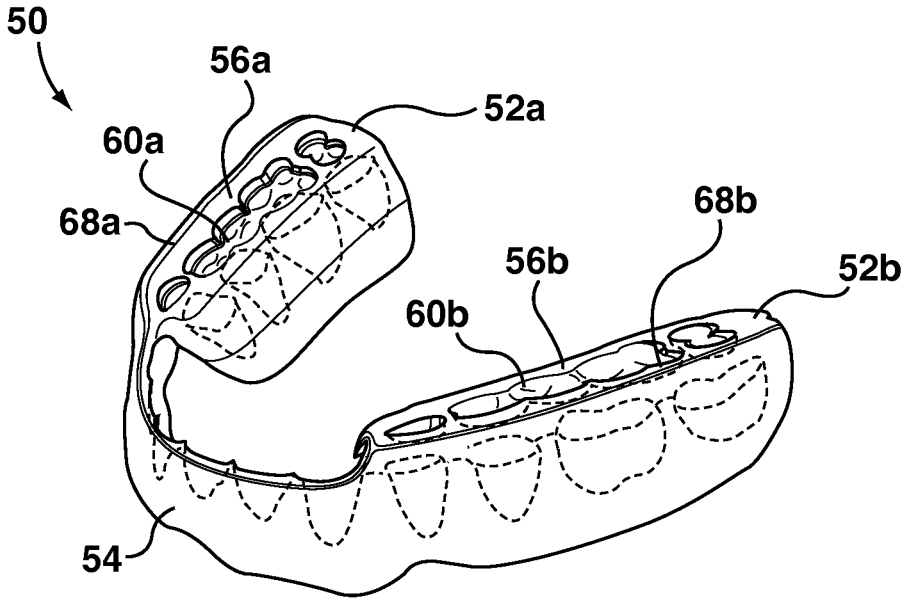
FIGS. 9A and 9B are front, upper, right perspective and rear, lower, left perspective views, respectively, of the customized mouthpiece shown in FIG. 8.
Figure 9B:
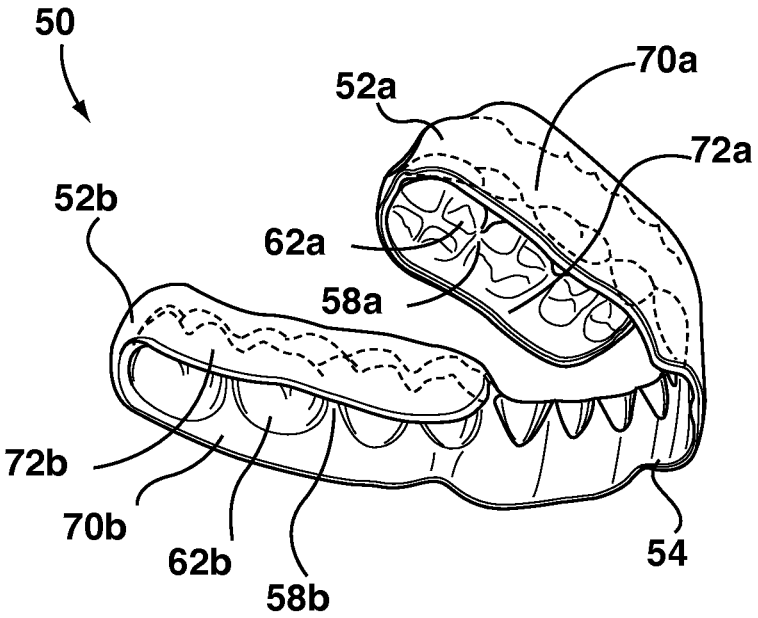

With particular reference to FIGS. 8, 9A and 9B, the bite portion 52*a* includes an upper engagement surface 56*a* and a lower engagement surface 58*a*; the bite portion 52*b* includes an upper engagement surface 56*b* and a lower engagement surface 58*b*. The upper engagement surfaces 56*a*, 56*b* face the teeth 26 of the upper jaw 22, and the lower engagement surfaces 58*a*, 58*b* face the teeth 28 of the lower jaw 24. The upper and lower engagement surfaces 56*a*, 56*b*, 58*a*, 58*b* are configured to engage the upper and lower teeth 26, 28 and substantially prevent movement of the lower jaw 24 relative to the upper jaw 26.

In some examples, the upper engagement surfaces 56*a*, 56*b* can include upper indentations 60*a*, 60*b*, respectively. The upper indentations 60*a*, 60*b* are complementary to at least portions of the teeth 26 of the upper jaw 22. Similarly, the lower engagement surfaces 58*a*, 58*b* can include lower indentations 62*a*, 62*b*, respectively. The lower indentations 62*a*, 62*b* are complementary to at least portions of the teeth 28 of the lower jaw 24.

Figure 11A:
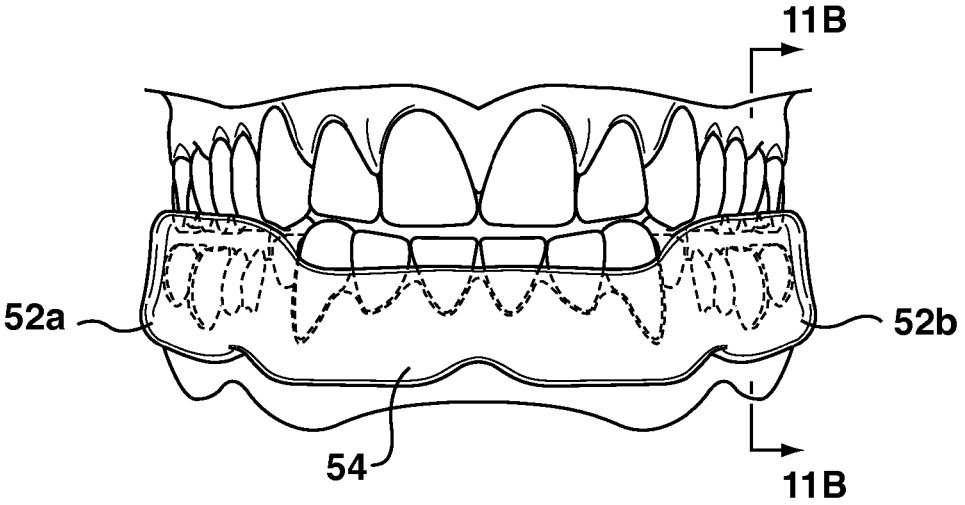
FIGS. 11A and 11B are front and sectional views, respectively, of the athlete and the customized mouthpiece shown in FIG. 8.

As illustrated in FIG. 11A, the mouthpiece 50 can be configured so that the bite portions 52*a*, 52*b* engage the posterior teeth of the teeth 26 of the upper jaw 28 and the teeth 28 of the lower jaw 24. In other words, the bite portions 52*a*, 52*b* can be arranged distally relative to the anterior teeth, whereas the connecting portion 54 can be arranged mesially relative to the posterior teeth.

Using FDI World Dental Federation notation, posterior teeth can be defined as teeth which are numbers 1-8, 1-7, 1-6, 1-5, 1-4, 2-4, 2-5, 2-6, 2-7, 2-8, and anterior teeth can be teeth which are numbers 1-3, 1-2, 1-1, 2-1, 2-2, 2-3. However, other configurations are possible and within the scope of the teachings herein. For example, the bite portions 52*a*, 52*b* can only partially engage teeth numbers 1-4, 2-4, 3-4, 4-4, or not engage teeth numbers 1-4, 2-4, 3-4, 4-4 at all. However, generally speaking and depending on the particular athlete, for stability purposes it may be desirable for the bite portions 52*a*, 52*b* to at least partially engage teeth numbers 1-8, 1-7, 1-6, 1-5, 2-5, 2-6, 2-7, 2-8, 4-8, 4-7, 4-6, 4-5, 3-5, 3-6, 3-7, 3-8.

In the particular example illustrated, the connecting portion 54 extends labially along the anterior teeth and associated gum region of the teeth 28 of the lower jaw 24. The connecting portion 54 is sized and shaped to substantially lie out of the way so as to not substantially impede speech of the athlete. As illustrated in FIG. 11A, the anterior teeth can be teeth numbers 4-3, 4-2, 4-1, 3-1, 3-2, 3-3. In some examples, the connecting portion 54 can extend from below the gingival line to mid-incisal of the anterior teeth. In other words, the anterior teeth can be exposed from the incisal edge to mid-incisal. The connecting portion 54 can extend about 2 mm below the gingival line at its lowest point, which can be at the mandibular canines (teeth numbers 4-3 and 3-3).

However, it should be appreciated that the size and shape of the connecting portion 54 can vary depending on the athlete and the material selected to form the mouthpiece 50. In other words, dimensions of the connecting portion 54 will vary case by case, and can be selected by considering a balance of strength of the material versus the athlete's tolerance for size. In some examples, the height dimension 64 of the connecting portion 54 can be about 8 mm, and the depth dimension 66 can be about 1 mm (see FIGS. 10B and 10C). In other examples, the height dimension 64 of the connecting portion 54 can be about 6 mm, and the depth dimension 66 can be about 1.5 mm (see FIGS. 8B and 8C).

Furthermore, it will be appreciated that, in other examples in which the mouthpiece is a "lower" oral appliance, the connecting portion may extend lingually along the anterior teeth and associated gum region of the lower jaw and connect the bite portions within the mouth, or the connecting portion may be a combination of both labial and lingual connecting portions. Moreover, in yet other examples, the mouthpieces may take the form of an "upper" mouthguard, in which the connecting portion extends labially along the anterior teeth and associated gum region of the upper jaw and connects the bite portions within the mouth, and optionally with a lingual (i.e. palettal) connecting portion. Accordingly, the teachings herein may not be limited to the preparation of mouthpieces having a connecting portion that extends labially along the anterior teeth and associated gum region of the lower jaw.

Figure 10C:
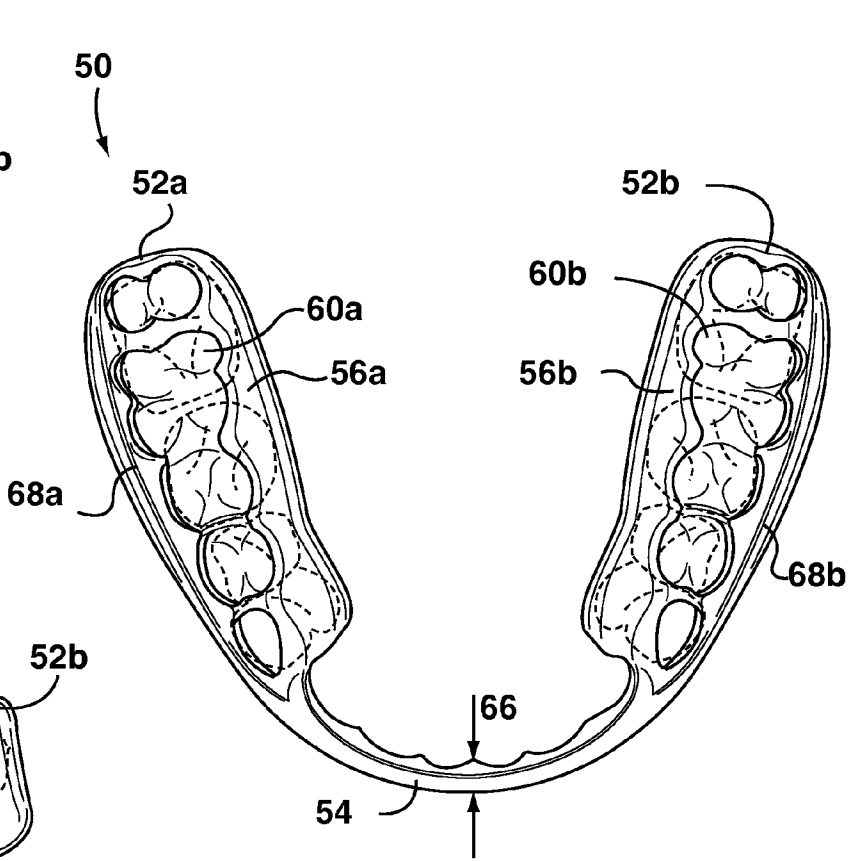
FIGS. 10A, 10B and 10C are side, front and top, respectively, of the customized mouthpiece shown in FIG. 8.
Figure 10A:
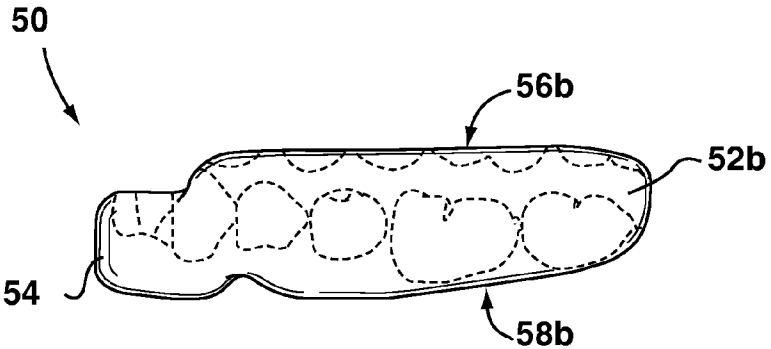
Figure 10B:
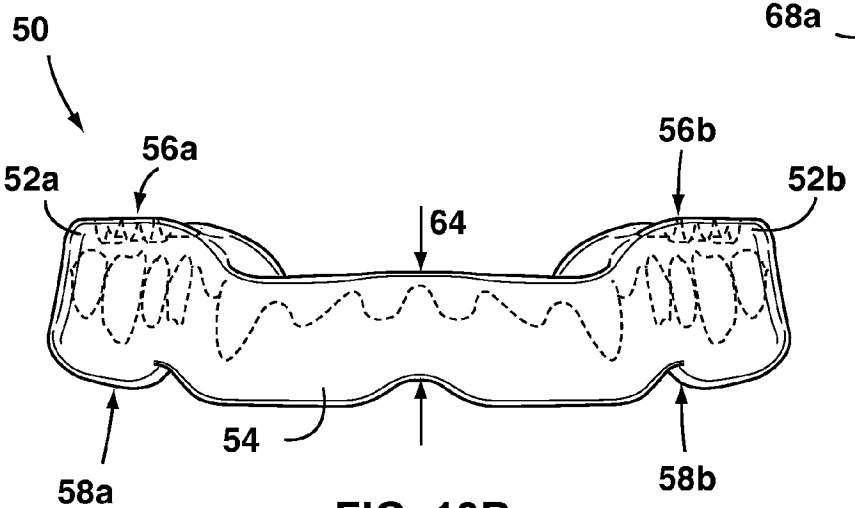
Figure 11B:
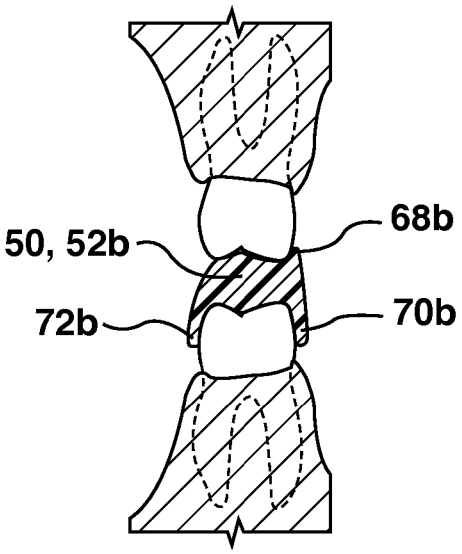

Referring again to the illustrated example, FIG. 11B shows a sectional view of the mouthpiece 50 in engagement with maxillary and mandibular second molars (teeth numbers 2-7 and 3-7). With particular reference to FIGS. 8, 10C and 11B, the upper engagement surfaces 56*a*, 56*b* can each further include an upper buccal rail 68*a*, 68*b*, respectively. The upper buccal rails 68*a*, 68*b* are raised relative to the upper engagement surfaces 56*a*, 56*b* and are positioned to engage buccal surfaces of at least a portion of the upper posterior teeth, thereby preventing lateral movement of the lower jaw 24 relative to the upper jaw 22.

Furthermore, with particular reference to FIGS. 8, 9B and 11B, the lower engagement surfaces 58*a*, 58*b* can each further include a lower buccal wall 70*a*, 70*b* and a lower lingual wall 72*a*, 72*b*, respectively. The lower buccal walls 70*a*, 70*b* can be generally opposing the lower lingual walls 72*a*, 72*b*, respectively, and are spaced apart to receive at least a portion of the lower posterior teeth therebetween.

Figure 12A:
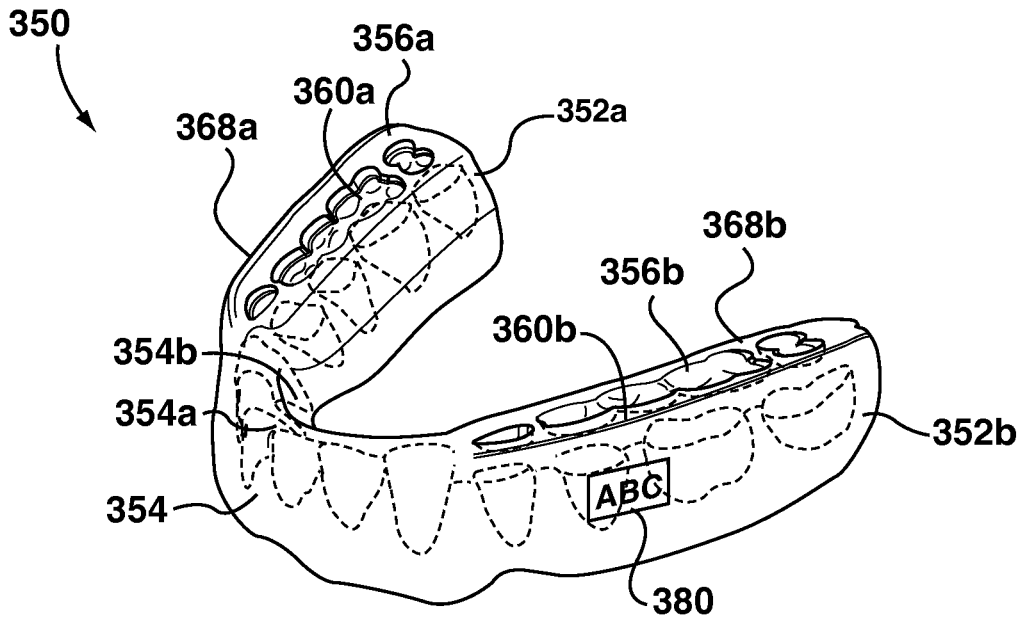
FIGS. 12A and 12B are front, upper, right perspective views of other customized mouthpieces.
Figure 12B:
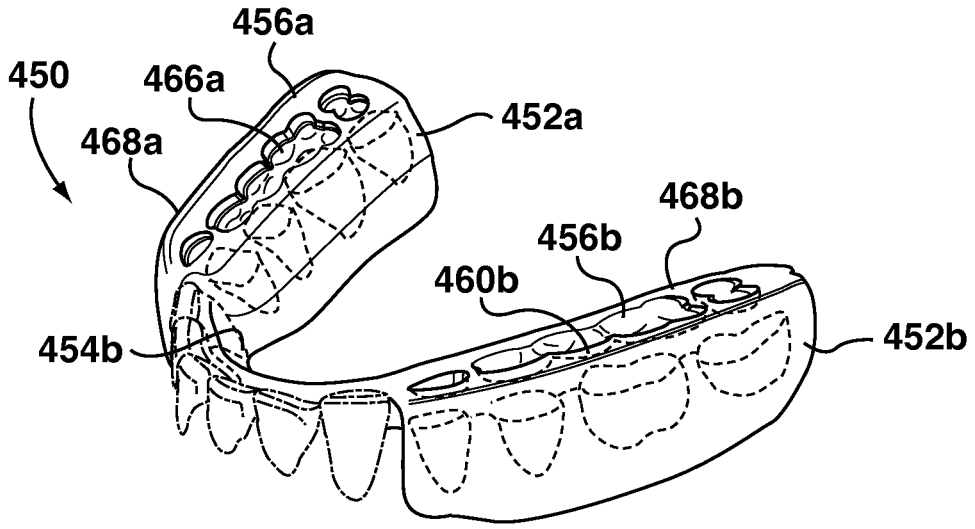

Although the mouthpiece 50 is illustrated as a mouthpiece for the bottom teeth, and includes a labial connecting portion 54, other configurations of the mouthpiece are contemplated. Referring to FIGS. 12A and 12B, other examples of mouthpieces 350, 450 are shown, with like features identified with like reference numbers. The mouthpiece 350 includes an upper anterior connecting portion 354*a* and a lingual anterior connecting portion 354*b*, in addition to the labial anterior connecting portion 354. The mouthpiece 350 can also be formed to include visible indicia 380. For example, the visible indicia 380 can include a corporate logo or the athlete's name. The mouthpiece 450 includes only a lingual anterior connecting portion 454*b*. Other configurations are possible, and it should be appreciated, for example, that mouthpieces could be prepared in accordance with the teachings herein that take the form of a typical mouthguard that provides protection for the upper teeth 26.

As described in further detail in the examples below, the mouthpieces 50, 350 or 450 can be formed of two or more layers of material bonded to one another. The layers can be of different materials. Assuming at least the outside layer is transparent or translucent, the indicia 380 can be placed between the layers during a forming step. The mouthpieces 50, 350 or 450 can be formed of various thermoplastic or acrylic materials, or a combination thereof. Some possibly suitable thermoplastic materials include the materials sold under the brand names TALON™, BITEM™, and ASTRON™. Some possibly suitable acrylic materials include materials sold under the brand names IVOCAP™, LANG™, GREAT LAKES™, and IMPAK™. The mouthpieces 50, 350 or 450 can be formed by manual forming techniques, or by vacuum or pressure forming, or a combination thereof. A suitable pressure forming system is sold under the brand name BIOSTAR™.

Referring back to FIGS. 2 and 7, the following non-limiting examples of preparing a mouthpiece are provided as illustrative of the secondary stage 104 of the method 100 or of the secondary stage 204 of the method 200. It should appreciated that the materials and techniques described in example 1 could be used for the secondary stage 204 of the method 200, and the materials and techniques described in example 2 could be used for the secondary stage 104 of the method 100.

Example 1

Referring to step 120 in FIG. 2, a mouthpiece in accordance with the mouthpiece 50 described above can be formed by first generating upper and lower molds based on the upper and lower impressions taken in 118. The mouthpiece can be formed using these molds and a plurality of laminating and/or manual forming steps.

In particular, in a preliminary forming step, the lower mold can be placed in a BIOSTAR™ pressure forming system, and a 4×125 mm disk of GREAT LAKES™ material can be laminated thereon. After the first laminating step, the lower mold and plastic can be removed from the forming system, and excess material trimmed away. As a second laminating step, a 2×125 mm disk GREAT LAKES™ material can be applied, also using the BIOSTAR™ pressure forming system. Optionally, heat can be manually applied (e.g., using a heat gun) to the first layer before application of the second layer, ensuring good bonding between the layers. After the second laminating step, the lower mold and plastic can be removed from the forming system, and excess material trimmed away. Further laminating steps using the pressure forming system can be carried out. The number of layers and thickness of each layer will vary depending on the desired thickness of the mouthpiece, and in particular the vertical amplitude of the desired position previously determined. Despite the desired position determined in stage 102, the vertical amplitude may optionally be closed by, for example, 1.0 mm, to provide a mouthpiece that is more comfortable for the athlete.

The inventors have found that mouthpieces that are formed of two or more layers can be more rigid than mouthpiece that is formed of a single layer. Furthermore, using two or more layers enables visible indicia to be placed between the layers.

Next, in step 122, the lower mold with multiple layers of plastic and the upper mold can be installed in an articulator. For example, a STRATOS 100™ or STRATOS 300™ articulator can be used. The upper and lower molds can be fixed in the articulator according to the bite registration selected at step 116. In step 124, to form of fabricate the mouthpiece, in some examples, one or more layers of thermoplastic material can then be manually heated and applied to the lower jaw, on top of the laminated plastic, to build the thickness up. The articulator can be closed to capture occlusal indentations of opposing teeth and spacing thereof.

In step 126, anterior upper and lingual portions can be removed, leaving the connecting portion that extends labially along the anterior teeth and associated gum region of the lower jaw. For example, a SCHUTZ™ felt wheel can be used. Other trimming can be carried out, using, for example, a SCHUTZ™ felt wheel. An exterior border of appliance can be trimmed to the tissue contours. Other trimming can be done to remove rough edges and excess material. Furthermore, the mouthpiece can be flamed with torch to develop smooth and shiny surface. A buffing step can be carried out using MOLDENT™, and/or a polishing step using KENDA 4-BLUE™.

Use of relatively soft thermoplastic material results in a mouthpiece that may be suitable for athletes participating in sports with a greater possibility of impact, for example, cyclists, tennis players, baseball players, volleyball players, etc.

Example 2

Referring to step 214 in FIG. 7, a mouthpiece in accordance with the mouthpiece 50 described above can be formed by first generating upper and lower molds based on the upper and lower impressions taken in 212. The mouthpiece can be formed using these molds and a plurality of laminating and/or manual forming steps.

In particular, in a first preliminary fabricating step, the lower mold can be placed in a BIOSTAR™ pressure forming system, and a 2.5×125 mm DURASOFT™ material can be laminated thereon. After the laminating step, the lower mold and plastic can be removed from the forming system, and excess material trimmed away. Further laminating steps using the pressure forming system can be carried out. The number of layers and thickness of each layer will vary depending on the desired thickness of the mouthpiece.

Next, in step 216, the lower mold with plastic and the upper mold can be installed in an articulator. For example, a STRATOS 100™ or STRATOS 300™ articulator can be used. The upper and lower molds can first be fixed in the articulator according to the centric occlusion bite registration recorded at steps 210. Once mounted on the articulator, positions of the upper and lower molds can be shifted so that the vertical amplitude is increased by a first predetermined dimension, which can be, for example but not limited, between about 1.8 mm and 3.8 mm. The anterior-posterior amplitude can be increased by a second predetermined dimension, which can be, for example but not limited, between about 0.5 mm and 1.5 mm.

For the forming or fabricating step 218, a suitable acrylic can be mixed. Cold cure and hot cure acrylics are possible, but cold cure is generally easier to work with and more efficient for forming. Good results have been obtained using ORTHO-JET POWDER™. One or more layers of acrylic material can then be manually applied to the lower jaw, on top of the laminated plastic, to build the thickness up. The articulator can be closed to capture occlusal indentations of opposing teeth and spacing thereof. A finishing layer of acrylic can be applied to buccal walls to prevent irregular contours of buccal and lingual aspects.

In step 220, anterior upper and lingual portions can be removed, leaving the connecting portion that extends labially along the anterior teeth and associated gum region of the lower jaw. For example, a SCHUTZ™ felt wheel or a carbide burr can be used. Other trimming can be carried out, using, for example, a felt wheel. An exterior border of appliance can be trimmed to the tissue contours. Other trimming can be done to remove rough edges and excess material. Furthermore, the mouthpiece can be pre-polished with pumice. A buffing step can be carried out using MOLDENT™, and/or a polishing step using KENDA 4-BLUE™.

The resulting mouthpiece is formed of a thermoplastic generally on the lower portion (i.e. lower surfaces 68*a*, 68*b* in FIG. 7B) and acrylic generally on the upper portion (i.e. upper surfaces 66*a*, 66*b* in FIG. 7A). Acrylic material results in a mouthpiece that is slightly harder than the thermoplastic-only mouthpiece, and may be suitable for athletes participating in sports with a lesser possibility of impact, for example, golfers, runners, swimmers, archers, etc.

While the above description provides examples of one or more processes or apparatuses, it will be appreciated that other processes or apparatuses may be within the scope of the accompanying claims.

We claim:

1. A method of preparing a customized mouthpiece for an athlete, the athlete having a mouth, an upper jaw with anterior and posterior teeth, a lower jaw with anterior and posterior teeth, and a temporomandibular joint movably connecting the upper and lower jaws, the method comprising the steps of:

a) positioning a spacing member between the teeth of the upper and lower jaws to obtain a desired position between the upper and lower jaw;

b) recording at least one bite registration of the athlete while the lower jaw is in the desired position; and c) forming the mouthpiece, the mouthpiece including a pair of bite portions configured to substantially space apart and position the lower jaw relative to the upper jaw generally according to the desired position, and a connecting portion connecting the bite portions within the mouth, each of the bite portions including an upper engagement surface facing the posterior teeth of the upper jaw and a lower engagement surface facing the posterior teeth of the lower jaw, the upper and lower engagement surfaces configured to engage the upper and lower posterior teeth, respectively, and substantially prevent movement of the lower jaw relative to the upper jaw, wherein, in step (a), the spacing member is positioned generally between the anterior and posterior teeth of the upper and lower jaws, and wherein the spacing member comprises a cylindrical shaft having a diameter of between 1.0 mm and 12.0 mm.

2. The method of claim 1, further comprising, prior to step (a):

applying transcutaneous electric neural stimulation generally to the temporomandibular joint;

ceasing the transcutaneous electric neural stimulation, and allowing the lower jaw to relax to a resting position; and repeating the steps of applying and ceasing at least two more times to ensure thorough deprogramming of muscles associated with the temporomandibular joint.

3. The method of claim 2, wherein, in the step of applying, the transcutaneous electric neural stimulation is applied at an amplitude that is slightly less than an amplitude that would cause the teeth of the upper and lower jaws to contact.

4. The method of claim 3, wherein the amplitude at which the transcutaneous electric neural stimulation is applied is determined using electromyography to track movement of the lower jaw relative to the upper jaw, and increasing the transcutaneous electric neural stimulation until the teeth of the upper and lower jaws contact.

5. The method of claim 4, wherein, in the step of applying, the transcutaneous electric neural stimulation is applied for between about 10 to 20 seconds.

6. The method of claim 5, wherein the transcutaneous electric neural stimulation is applied generally to a cranial nerve V and a cranial nerve VII of the athlete.

7. The method of claim 1, wherein step (c) comprises:

taking impressions of the anterior and posterior teeth of the upper and lower jaws;

generating upper and lower molds from the impressions;

mounting the upper and lower molds on an articulator;

inserting the bite registration in the upper and lower molds to space apart the upper and lower molds generally according to the desired position;

removing the bite registration; and forming the mouthpiece between the upper and lower molds while substantially in the desired position.

8. The method of claim 7, wherein the step of forming comprises applying a plurality of layers to form the mouthpiece.

9. The method of claim 8, wherein the layers are formed of different materials.

10. The method of claim 9, wherein the upper engagement surfaces are formed at least partially of an acrylic material and the lower engagement surfaces are formed at least partially of a thermoplastic material.

11. The method of claim 8, further comprising placing visible indicia placed between the layers.

12. The method of claim 8, further comprising manually heating a first layer before application of a second layer.

13. The method of claim 7, wherein the step of forming comprises manual forming, vacuum forming or pressure forming.

14. The method of claim 7, wherein, after removing the bite registration and prior to forming the mouthpiece, vertical amplitude between the upper and lower molds is reduced by up to 1.0 mm.

15. The method of claim 1, wherein, prior to step (a), bite registration material is injected generally between the posterior teeth, step (a) comprises engaging the teeth of the upper and lower jaws with the spacing member to define the desired position, and step (b) comprises waiting for the bite registration material to harden while the lower jaw is maintained in the desired position.

16. The method of claim 15, further comprising, after step (a) and prior to step (b), injecting bite registration material generally between the anterior teeth of the upper and lower jaws.

17. The method of claim 1, further comprising, prior to step (a), applying transcutaneous electric neural stimulation generally to the temporomandibular joint for a period of time sufficient to deprogram muscles associated with the temporomandibular joint.

18. The method of claim 17, wherein the period of time is between 45 and 75 minutes.

19. The method of claim 1, wherein the spacing member comprises a cylindrical shaft having a diameter of between 2.0 mm and 7.0 mm.

20. The method of claim 1, further comprising, prior to step (a), providing a plurality of the cylindrical shafts having varying diameters, evaluating each of the plurality of the cylindrical shafts with the athlete, and selecting one of the plurality of the cylindrical shafts to use to obtain the desired position.

21. The method of claim 1, wherein step (b) comprises recording a plurality of bite registrations of the athlete while the lower jaw is in the desired position, and further comprising evaluating each of the plurality of bite registrations with the athlete, and selecting one of the plurality of bite registrations.

22. The method of claim 1, wherein the connecting portion extends labially along the anterior teeth and associated gum region of the lower jaw, and is sized and shaped to substantially lie out of the way so as to not impede speech of the athlete.

23. A method of preparing a customized mouthpiece for an athlete, the athlete having a mouth, an upper jaw with anterior and posterior teeth, a lower jaw with anterior and posterior teeth, and a temporomandibular joint movably connecting the upper and lower jaws, the method comprising the steps of:

recording a bite registration of the athlete when the lower jaw is substantially in a centric occlusion position;

taking impressions of the anterior and posterior teeth of the upper and lower jaws;

generating upper and lower molds from the impressions;

mounting the upper and lower molds using an articulator;

inserting the bite registration in the upper and lower molds to space apart the upper and lower molds;

shifting the upper and lower molds in the articulator to increase a vertical amplitude by a first predetermined dimension and increase an anterior-posterior amplitude by a second predetermined dimension, thereby defining a desired position; and forming the mouthpiece between the upper and lower molds while substantially in the desired position, the mouthpiece including a pair of bite portions configured to substantially space apart and position the lower jaw relative to the upper jaw according to the desired position, and a connecting portion connecting the bite portions within the mouth, each of the bite portions including an upper engagement surface facing the posterior teeth of the upper jaw and a lower engagement surface facing the posterior teeth of the lower jaw, the upper and lower engagement surfaces configured to engage the upper and lower posterior teeth, respectively, and substantially prevent movement of the lower jaw relative to the upper jaw.

24. The method of claim 23, wherein the step of forming comprises applying a plurality of layers to form the mouthpiece.

25. The method of claim 24, wherein the layers are formed of different materials.

26. The method of claim 25, wherein the upper engagement surfaces are formed at least partially of an acrylic material and the lower engagement surfaces are formed at least partially of a thermoplastic material.

27. The method of claim 24, further comprising placing visible indicia placed between the layers.

28. The method of claim 24, further comprising manually heating a first layer before application of a second layer.

29. The method of claim 23, wherein the first predetermined dimension is between 1 and 4 mm, and the second predetermined dimension is between 0.2 and 3 mm.

30. The method of claim 23, wherein the first predetermined dimension is between 1.8 and 3.8 mm, and the second predetermined dimension is between 0.5 and 1.5 mm.

31. The method of claim 23, wherein, prior to the recording step, bite registration material is injected generally between the posterior teeth, and the recording step comprises placing the lower jaw in the centric occlusion position relative to the upper jaw, and waiting for the bite registration material to harden while the lower jaw is maintained in the centric occlusion position.

32. The method of claim 23, wherein the step of forming comprises manual forming, vacuum forming or pressure forming.

33. The method of claim 23, wherein the connecting portion extends labially along the anterior teeth and associated gum region of the lower jaw, and is sized and shaped to substantially lie out of the way so as to not impede speech of the athlete.

34. A method of preparing a customized mouthpiece for an athlete, the athlete having a mouth, an upper jaw with anterior and posterior teeth, a lower jaw with anterior and posterior teeth, and a temporomandibular joint movably connecting the upper and lower jaws, the method comprising the steps of:

injecting bite registration material generally between the posterior teeth;

positioning a spacing member between the teeth of the upper and lower jaws to obtain a desired position between the upper and lower jaw, and comprising engaging the teeth of the upper and lower jaws with the spacing member to define the desired position;

recording at least one bite registration of the athlete while the lower jaw is in the desired position, and comprising waiting for the bite registration material to harden while the lower jaw is maintained in the desired position; and forming the mouthpiece, the mouthpiece including a pair of bite portions configured to substantially space apart and position the lower jaw relative to the upper jaw generally according to the desired position, and a connecting portion connecting the bite portions within the mouth, each of the bite portions including an upper engagement surface facing the posterior teeth of the upper jaw and a lower engagement surface facing the posterior teeth of the lower jaw, the upper and lower engagement surfaces configured to engage the upper and lower posterior teeth, respectively, and substantially prevent movement of the lower jaw relative to the upper jaw.

35. The method of claim 34, further comprising, prior to the step of recording, injecting the bite registration material generally between the anterior teeth of the upper and lower jaws.

* * * * *